United States Patent [19]

Reichert

[11] 4,204,451

[45] * May 27, 1980

[54] CUTTING BLOCK EMPLOYING CUTTABLE RODS

[76] Inventor: Leonard K. Reichert, 16 Euston St., Brookline, Mass. 02146

[ * ] Notice: The portion of the term of this patent subsequent to Mar. 13, 1996, has been disclaimed.

[21] Appl. No.: 881,049

[22] Filed: Feb. 24, 1978

Related U.S. Application Data

[63] Continuation-in-part of Ser. No. 861,631, Dec. 19, 1977, Pat. No. 4,143,753.

[51] Int. Cl.[2] ..... B26D 7/20

[52] U.S. Cl. ..... 83/658; 83/698; 269/302.1

[58] Field of Search ..... 83/658, 537, 533, 698; 269/302.1

[56] References Cited

U.S. PATENT DOCUMENTS

| | | | |
|---|---|---|---|
| 307,731 | 11/1884 | Rowe | 83/658 X |
| 1,174,625 | 3/1916 | Sellers | 269/302.1 |
| 1,404,831 | 1/1922 | Buckner | 83/658 X |
| 3,166,967 | 1/1965 | Garritt, Jr. | 83/658 |
| 3,306,148 | 2/1967 | Oesterreicher | 83/658 |
| 4,143,573 | 3/1979 | Reichert | 83/658 |

*Primary Examiner*—Frank T. Yost

*Attorney, Agent, or Firm*—Gary A. Walpert

[57] ABSTRACT

A cutting block or pad having a laminated construction, wherein the adjacent component layers or member elements are bonded to each other, and having at least one cuttable rod member passing therethrough is disclosed. The rods extend within the interior of the block, passing through the component layers, and each rod is preferably secured in position to provide mechanical strength to the laminated structure. The rods each have a resistance to cutting less than a predetermined die damage level and preferably comparable to the component layers of the laminated construction. The block is particularly useful in connection with a clicking die.

13 Claims, 4 Drawing Figures

CUTTING BLOCK EMPLOYING CUTTABLE RODS

CROSS-REFERENCE TO RELATED APPLICATIONS

This application is a continuation-in-part of my copending application Ser. No. 861,631, filed Dec. 19, 1977, now U.S. Pat. No. 4,143,753 issued Mar. 13, 1979.

BACKGROUND OF THE INVENTION

The invention relates in general to cutting blocks for use in a die cutting machine and in particular to laminated cutting blocks having rod members extending therethrough.

Die cutting machines, commonly known as clickers, are used for cutting blanks of sheet material, for example, leather, paper, vinyl, etc. These machines have a stationary cutting block or bed upon which the stock or blank to be cut is spread and a movable striking element or arm by which a sharp edged die, placed on top of the blank, is driven by impact through the blank.

Typically, the cutting block, that is, the bed upon which the stock is placed, is a laminated structure having a plurality of sections adhesively secured and providing a broad planar cutting surface on which to place the stock or blank. In use, as the die strikes and is driven through the blank, the die tends to slowly cut and wear away the surface of the cutting block. The problem is aggravated, however, as the commercial requirements for die-cutting machines become more severe, and it is not surprising that as throughput increases, the accuracy with which the die is stopped then tends to be less controllable and hence the cutting block surface begins to wear away more quickly.

The cutting blocks often have rods passing therethrough to reinforce the block against the stresses set up in the die cutting machines. The rods are typically metal and substantially limit the effective life of the cutting block as the die begins to wear away the surface of the block. Thus, after the surface is worn away a relatively small amount (relative to the overall thickness of the block), the cutting block must be removed because of the danger that the die will hit or contact the metal rod surface, thereby causing damage to the die.

A principal object of the invention is therefore to provide a cutting block which will not damage the cutting die even after a substantial portion of the block has been worn away. Other objects of this invention are to provide a cutting block which has a long life, which is reliable, which is simple to assemble, and which is low in cost. Still further objects of the invention include providing a cutting block which is mechanically secure and which can be constructed in any convenient size.

SUMMARY OF THE INVENTION

A cutting block according to the invention features, in one aspect, an integral laminated structure having a plurality of member elements and having at least one substantially planar broad cutting surface. The block further features at least one rod member extending within the laminated structure and passing through at least two of the member elements. Each rod member is composed of a material having a resistance to cutting below a predetermined die damage level.

In a preferred aspect of the invention, the rod members have a resistance to cutting no greater than approximately the resistance to cutting of the member elements. In addition, in a preferred aspect of the invention, adjacent member elements are bonded to one another at their abutting surfaces by an adhesive layer and the adhesive has a resistance to cutting below the die damage level.

The cutting block according to the invention features, in yet another aspect, a plurality of planar members, each member having a thickness between planes small compared to its length. The planar members are assembled to form an integral laminated structure. The laminated structure has substantially planar broad opposing surfaces. The cutting block also includes at least one rod member extending within the laminated structure and passing through at least two of the planar members, and each rod member is composed of a material having a resistance to cutting below the predetermined die damage level.

In a preferred embodiment of the invention, adjacent planar members are bonded to one another at their planar surfaces by an adhesive layer. The rod members, at each of their ends, preferably have means for mechanically securing the laminated structure together thereby applying a compression force to the structure.

DESCRIPTION OF THE DRAWINGS

Other objects, features and advantages of the invention will appear from the following description of the preferred embodiment of the invention taken together with the drawings in which.

DESCRIPTION OF A PREFERRED EMBODIMENT

Figure 1:
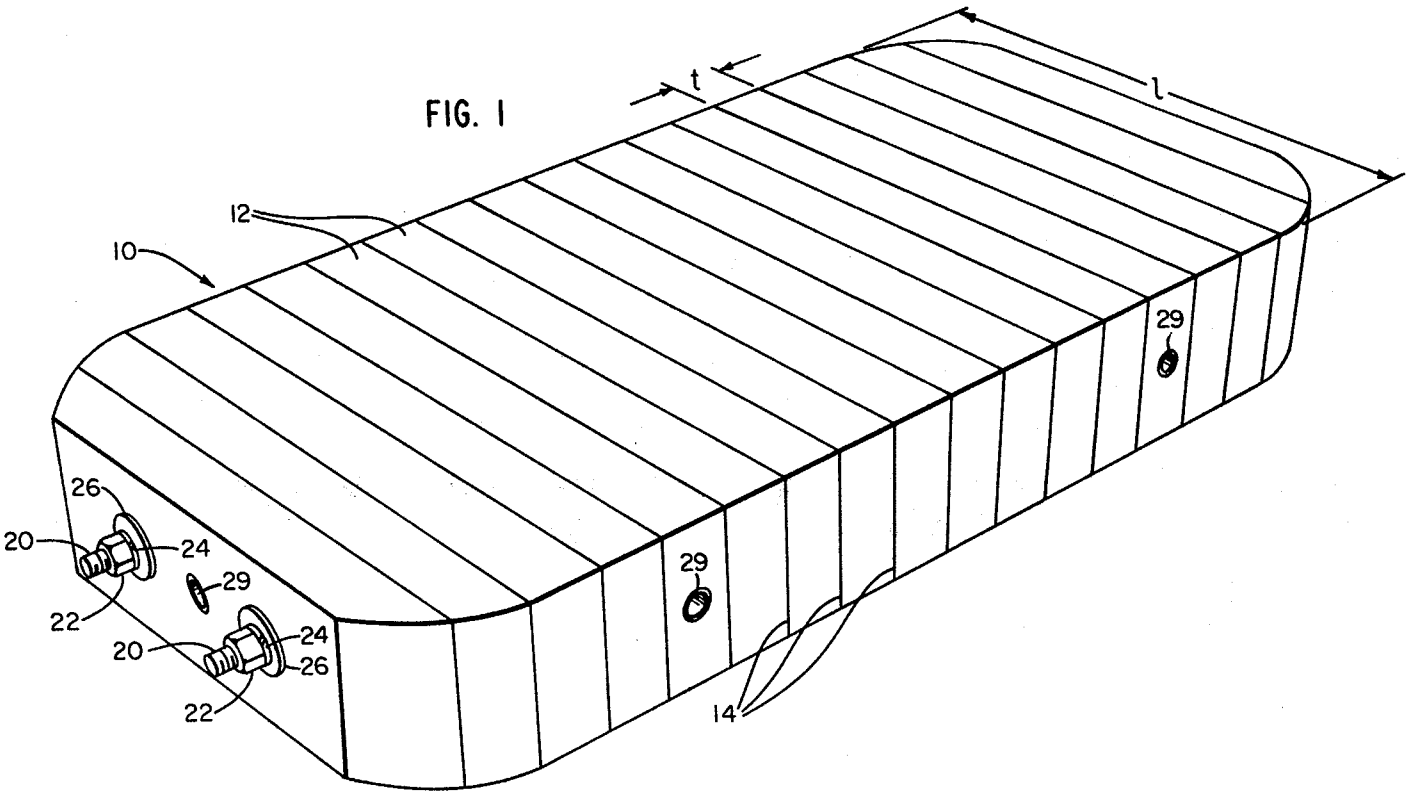
FIG. 1 is a perspective view of a cutting block constructed according to the invention.

Referring to FIG. 1, a cutting block 10 constructed according to the invention comprises a plurality of member elements 12, here planar members, each planar member having a thickness "t" between its plane surfaces small compared to its length "l." The cutting block 10 is a laminated structure in which adjacent member elements 12 are connected or bonded by an adhesive layer 14. Adhesive layers 14 are provided between each pair of adjacent member elements 12 and preferably form a substantially continuous layer between the planar, broad opposing surfaces 16 and 18 (FIG. 2) of the cutting block 10. In a preferred embodiment of the invention, layers 14 may be electrically conductive as described in my copending application Ser. No. 861,631.

Figure 2:
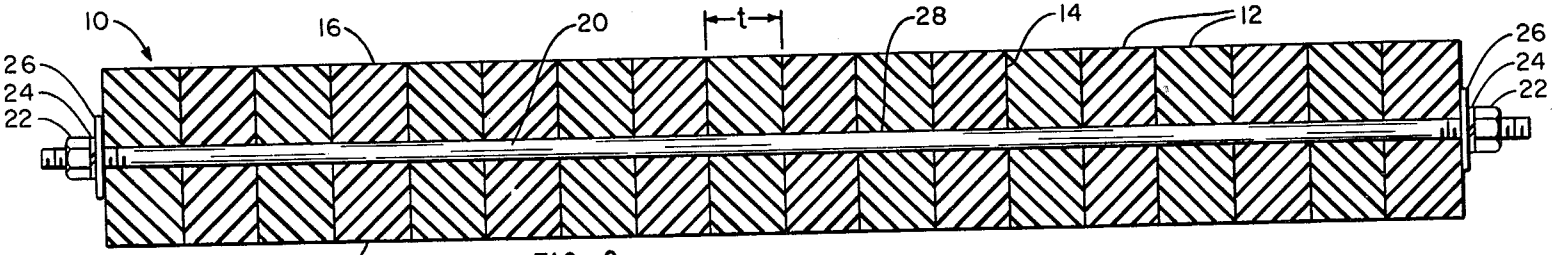
FIG. 2 is a longitudinal cross section of the cutting block of FIG. 1 taken through one of the rod members.

Referring to FIGS. 1 and 2, the illustrated cutting block 10 preferably includes at least one and preferably two elongated rod members 20. The illustrated rod members are preferably threaded, at least at their ends; and while preferably having a solid circular cross section, the rods may have any convenient cross section, may be hollow, and if hollow, may have perforations in the side walls. Each illustrated rod 20 extends internally through the entire laminated structure of cutting block 10 and is preferably secured at either end by nuts 22 and washers 24, 26. In other embodiments, rod members 20 may pass through a portion of the laminated structure instead of through the entire structure. Illustrated rods 20 are also bonded or secured within the illustrated laminated structure of cutting block 10, by an adhesive material 28 which may be and preferably is identical with the material composition of adhesive layers 14.

In the illustrated embodiment, a plurality of thimbles 29 (FIG. 1), comprising for example tubular stock, are press fit into predrilled holes spaced around the periphery of the cutting block. In use, the thimbles are operatively engaged by clamping elements (not shown) of the cutting machine, to secure the block in place. Other convenient methods for securing the thimbles in the block, such as an adhesive cement, may also be used.

The cutting block according to the invention may be made in any convenient size or shape. In the illustrated embodiment, eighteen 2" thick planar members 12, each having a length, for example, of eighteen inches and a height, for example, of three inches are assembled with a layer of adhesive cement applied to the opposing mating planar surfaces. The adhesive cement bonds the planar members 12 securely together to form the laminated structure having broad, planar opposing surfaces 16, 18. The members 12 may be comprised of any convenient material which is suitable for cutting, such as for example rubber composition, a plastic such as polypropylene, wood, etc., or a suitable combination thereof; however, preferred materials are rubber composition and polypropylene.

Holes are preferably predrilled in planar members 12 prior to assembling the laminated structure. (The holes may also be drilled after the laminated structure is assembled.) The planar members are then assembled on rods 20 and are bonded in place by applying the adhesive material 28 (which may be, and preferably is, the same as adhesive material 14 used between the illustrated planar members) both to the rod surface and in the drilled holes. Before the adhesive is set, the rods are bolted at their ends to provide additional mechanical support (preferably a compression force) to the cutting block. The nuts 22 and washers 24, 26 may also be bonded using the adhesive or may be fused to the rod, for example, by the application of heat to the assembly.

According to the invention, rods 20, thimbles 29, and adhesive layers 14 and 28 when set, are made of materials having a resistance to cutting below a predetermined die damage level, that is, below a minimum resistance level at which the die, if it strikes the rod, thimble, or adhesive layer, is damaged. Preferably, the rod and thimble material have mechanical properties similar to planar members 12, so that as the cutting block is worn away, the rods and thimbles present cutting properties which are similar to the cutting properties of the planar members, and therefore provide a longer life and lower effective cost for blocks 10. Thus, for example, the rods may also be made of a rubber composition, plastic such as an acrylic or polypropylene, wood, or any other suitable material.

As noted above, the rods may have substantially any configuration. In particular, when a hollow rod member having a perforate wall is used, it may be desirable to close off one end of the rod and apply an adhesive under pressure at the other end to provide good contact between the adhesive and the block members.

Figure 3:
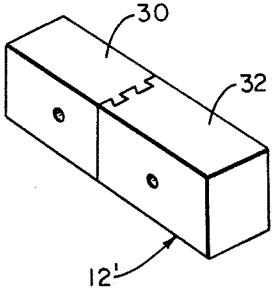
FIG. 3 is a perspective view of an alternate construction for the laminated structure member elements.

Referring to FIG. 3, in another particular embodiment of the invention, the members 12 may themselves be comprised of a plurality of sections 30, 32 which are mechanically interconnected and preferably bonded to form the planar members 12. The mechanical interconnections are well known in the art, for example, they may be the illustrated dovetail connections and a cement adhesive may be used to further strengthen the sections forming members 12.

Many other methods of construction could also be used to provide the cutting block of FIG. 1. Thus, without significant additional labor cost, a block twice the required height could be assembled and, except for drilling two additional holes for additional rods 20 and inserting and preparing additional rods in these added holes, the labor involved would be substantially identical to that for making a single block of the required height. Once the double height block is assembled, it would be divided in half to make two blocks, each having the required height. Similarly, other geometrical shapes for the block could be used.

Also, although a cutting block having two opposing broad planar surfaces 16 and 18 is preferred, the bottom surface, that is, the surface in contact with the cutting machine, need not be planar so long as it provides the support needed to enable the cutting block to perform its function under the forces applied by the cutting die.

Figure 4:
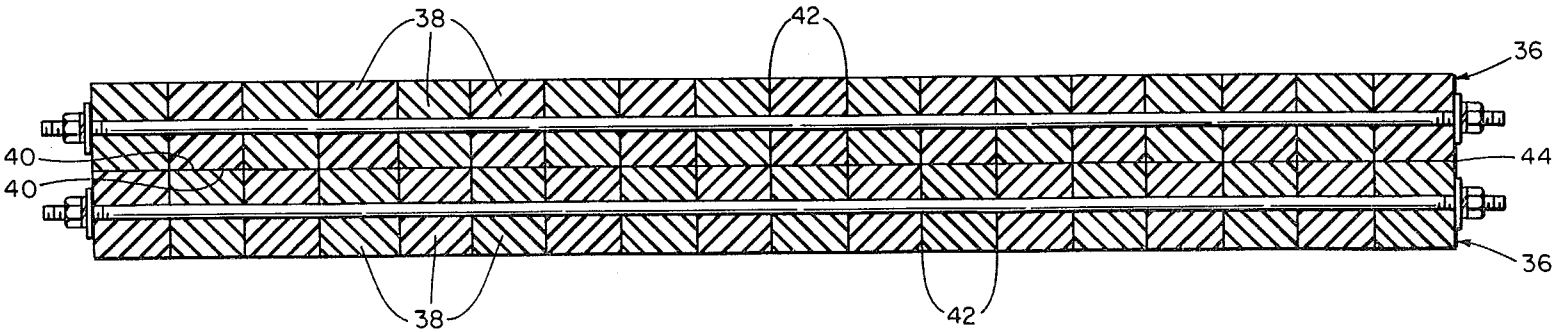
FIG. 4 is a longitudinal cross section of an alternative embodiment of the cutting block according to the invention.

Referring to FIG. 4, in an alternate embodiment of the invention, the cutting block comprises a plurality of laminated substructures 36, each substructure having a plurality of planar member elements 38 connected together and having at least one substantially planar broad bonding surface 40. The planar members of each substructure are bonded together preferably using layers 42 of an adhesive cement. The substructures 36 are then bonded together, at their broad bonding surfaces, by a cement layer 44. Holes are drilled in the assembled laminate or are predrilled in elements 38 or sections 30, 32 prior to assembly and a plurality of rod members 20 are secured thereto. In other embodiments, this "sandwich structure" may have more than the two illustrated layers.

Other embodiments of the invention wherein, for example, rod members 20 are not parallel to each other, or are formed in situ, and including additions, subtractions, deletions, and other modifications of the disclosed embodiments will be obvious to those skilled in the art and are within the scope of the following claims.

What is claimed is:

1. A cutting block comprising a plurality of planar members, each member having a thickness between planes small compared to its length, said planar members being assembled to form an integral laminated structure, said laminated structure having substantially planar, broad opposing surfaces, and at least one nonmetallic rod member extending within said laminated structure, each rod member passing through at least two of said members, and each of said rod member being comprised of a material having a resistance to cutting below a predetermined die damage level.

2. The cutting block of claim 1 wherein said rod member resistance to cutting is no greater than approximately the resistance to cutting of said planar members.

3. The cutting block of claim 1 wherein adjacent planar members are bonded to one another at their planar surfaces by an adhesive layer, and the adhesive has a resistance to cutting approximately equal to the resistance to cutting of said planar members.

4. The cutting block of claim 1 wherein each said rod, at each of its ends, has means for mechanically securing the laminated structure together.

5. The cutting block of claim 4 wherein there are two rods, said rods extending substantially parallel to one another and parallel to the opposing planar surfaces of the laminated structure.

6. A cutting block comprising a plurality of planar members, each member having a thickness between planes small compared to its length, the planar members being assembled to form an integral laminated structure, said laminated structure having substantially planar, parallel, broad opposing faces, each pair of adjacent planar members being bonded to one another at their planar surfaces by an adhesive layer, at least one rod member extending through the interior of said laminated structure and passing through each of said adhesive layers, each said rod, at its ends, having means for mechanically securing the laminated structure together, and each said rod having a resistance to cutting approximately equal to the resistance to cutting of said planar members.

7. A cutting block comprising an integral laminated structure having a plurality of member elements, at least one substantially planar broad cutting surface, and at least one nonmetallic rod member extending within said laminated structure, each rod member passing through at least two of said member elements, and each said rod member being comprised of a material having a resistance to cutting below a predetermined die damage level.

8. The cutting block of claim 7 wherein adjacent planar members are bonded to one another at their planar surfaces by an adhesive layer, and the adhesive has a resistance to cutting below said die damage level.

9. The cutting block of claim 7 wherein said member elements are assembled to form a plurality of integral laminated substructures, each substructure having at least one broad planar bonding surface, and said laminated substructures are joined along the broad planar bonding surfaces by an adhesive layer to form said laminated structure.

10. The cutting block of claim 7 further comprising a plurality of thimble elements spaced around an outside periphery of said block, and wherein each of said thimbles is comprised of a material having a resistance to cutting less than said die damage level.

11. The cutting block of claim 7 wherein each said rod has means associated with the rod ends for mechanically applying a compression force to the laminated structure.

12. The cutting block of claim 7 wherein said associated means are fused to said respective rod ends for permanently applying said compression force.

13. A cutting block comprising a plurality of planar members, each member having a thickness between planes small compared to its length, said planar members being assembled to form an integral laminated structure, said laminated structure having on one side a substantially planar broad cutting surface, each pair of adjacent members being bonded to one another at their planar surfaces by an adhesive layer, at least one rod member extending through said laminated structure and passing through each of said adhesive layers, and each said rod being nonmetallic and having a resistance to cutting less than a predetermined die damage level.

* * * * *